US006228242B1

(12) United States Patent
Lavelaine et al.

(10) Patent No.: US 6,228,242 B1
(45) Date of Patent: May 8, 2001

(54) PROCESS AND PLANT FOR ELECTROLYTICALLY COATING SURFACE OF A ROLL, FOR THE CONTINUOUS CASTING OF THIN METAL STRIP, WITH A METAL LASER

(75) Inventors: Hervé Lavelaine, Metz; Christian Allely, Longeville-lès-Metz; Eric Jolivet, Le Vesinet; Jean-Claude Catonne, La Celle st Cloud; Yann Breviere, Isbergues, all of (FR)

(73) Assignee: Thyssen Stahl Aktiengesellschaft, Puteaux (DE)

( * ) Notice: Subject to any disclaimer, the term of this patent is extended or adjusted under 35 U.S.C. 154(b) by 0 days.

(21) Appl. No.: 09/147,205

(22) PCT Filed: Jun. 6, 1997

(86) PCT No.: PCT/FR97/01000

§ 371 Date: Dec. 9, 1998

§ 102(e) Date: Dec. 9, 1998

(87) PCT Pub. No.: WO97/49843

PCT Pub. Date: Dec. 31, 1997

(30) Foreign Application Priority Data

Jun. 27, 1996 (FR) ..... 96 07981
Dec. 31, 1996 (FR) ..... 96 16255

(51) Int. Cl.[7] ..... C25D 5/00; C25D 7/04; C25D 17/00; C25B 9/00

(52) U.S. Cl. ..... 205/143; 205/137; 205/96; 205/151; 204/212; 204/272; 204/218; 204/224 R

(58) Field of Search ..... 205/143, 137, 205/96, 151, 134; 204/212, 272, DIG. 7, 218, 224 R

(56) References Cited

U.S. PATENT DOCUMENTS 2,044,415 6/1936 Yates ..... 204/6
5,582,709 * 12/1996 Delfrate et al. ..... 205/129

FOREIGN PATENT DOCUMENTS

261691 * 3/1988 (EP) .
0 261 691 3/1998 (EP) .
1138561 1/1969 (GB) .

OTHER PUBLICATIONS

International Search Report Sep. 30, 1997.

* cited by examiner

*Primary Examiner*—Edna Wong
(74) *Attorney, Agent, or Firm*—Nixon Peabody LLP; Thomas W. Cole

(57) ABSTRACT

Both a process and plant are provided for electrolytically coating with a metal layer the casting surface of a roll for twin-roll or single-roll continuous casting of thin metal strip. The casting surface is at least partially immersed in an electrolyte solution containing a salt of the metal to be deposited, so as to face at least one anode. The surface is placed at a cathode and a relative movement is created between the casting surface and the electrolyte solution. Insulating masks are interposed between the anode or anodes and the arrises of the casting surface, the insulating masks preventing a concentration of the lines of current on the arrises and in their vicinity.

12 Claims, 1 Drawing Sheet

PROCESS AND PLANT FOR ELECTROLYTICALLY COATING SURFACE OF A ROLL, FOR THE CONTINUOUS CASTING OF THIN METAL STRIP, WITH A METAL LASER

This a national stage application of PCT/FR97/01000 filed Jun. 6, 1997.

FIELD OF THE INVENTION

The invention relates to the continuous casting of metals. More specifically, it relates to the conditioning of the external surface of the roll or rolls which constitutes or constitute the moving wall or walls of the molds for the continuous casting of thin strip made of metals such as steel.

PRIOR ART

The molds of machines for the twin-roll continuous casting of steel strip a few mm in thickness directly from liquid metal comprise a casting space defined by the lateral surfaces of two rolls counter-rotating about their axes, which are maintained horizontal, and by two refractory side plates pressed against the ends of the rolls. These rolls have a diameter which may be as high as 1500 mm and a width which, on the current experimental plants, is approximately 600 to 800 mm. However, long term, this width will have to be as high as 1300 to 1500 mm in order to meet the productivity requirements of an industrial plant. These rolls usually consist of a steel core around which is fixed a copper or copper-alloy sleeve, the sleeve being cooled by circulating water between the core and the sleeve, or inside the sleeve.

Just like the surfaces of the molds for conventional continuous casting of blooms, billets or slabs, the surface of the sleeve which is to come into contact with the liquid metal may be coated with a metal layer, usually nickel, the thickness of which is in general as high as 1 to 2 mm. This nickel layer enables the heat transfer coefficient of the sleeve to be adjusted to an optimum value (this being lower than if the metal were brought directly into contact with the copper) so that the metal solidifies under proper metallurgical conditions: too rapid a solidification would cause defects on the surface of the product. This adjustment is carried out by varying the thickness and the structure of the nickel layer. On the other hand, it forms a protective layer for the copper, preventing it from being excessively stressed thermally and mechanically. This nickel layer wears out in the course of use of the roll, and it must be restored periodically by partial or complete removal of the remaining thickness, followed by deposition of a new layer, but such restoration obviously costs less than complete replacement of a worn bare copper sleeve.

The deposition of nickel is preferably carried out electrolytically, in the following manner. The new sleeve (a sleeve from which the nickel has been either partially or completely removed), which has overall the shape of a hollow cylinder made of copper or copper alloy, such as a copper—(1%) chromium—(0.1%) zirconium alloy, is mounted on an arbor, by means of which it can be readily transported from one treatment station to another in the nickel plating/nickel removal workshop. After having undergone various preparatory surface treatments (polishing, degreasing, acid pickling, etc.) for the purpose of improving the adhesion of the nickel to the copper, the sleeve is brought to the nickel electroplating station. This station consists of a tank containing the nickel-plating solution, above which the arbor may be placed in a horizontal position and made to rotate about its axis. Thus the lower part of the sleeve is dipped into the tank, and rotating the arbor/sleeve assembly at a speed of approximately 10 revolutions/min, for example, enables the treatment of the entire sleeve to be carried out. During the electroplating with nickel, the sleeve constitutes the cathode and the anode may consist of one or more titanium anode baskets immersed in the tank, which are closed by thin membranes, made to face the surface of the sleeve and contain nickel balls. If it is also desired to coat a major portion of the ends of the sleeve (which, during casting, rub against the refractory side plates and are therefore liable to wear out) with nickel, other anode baskets are arranged so as to face these ends. Other types of anodes (soluble or insoluble) may also be used.

As a variant, provision may be made for the sleeve to remain stationary and for it to be the electrolyte which moves past it. What is essential is therefore to create a relative movement, between the sleeve and their electrolyte, which ensures continuous renewal of their interface.

During casting runs, the nickel coating is exposed to very high stresses, both mechanical and thermal. The appearance of cracks in the nickel coating is often observed, near the edges of the rolls, after only a few casting runs. These cracks relate to regions a few cm in width starting from the arrises of the sleeve. They may lead to the formation of defects on the surface of the cast product since they cause the latter to be cooled non-uniformly. Above all, they constitute weak points from which very rapid degradation of the entire nickel coating may initiate. There may even be propagation of cracks beyond the nickel coating, which would lead to damage of the entire sleeve. These cracks therefore necessitate immediately and prematurely stopping the use of the roll and completely regenerating the coating on the sleeve. As this operation is lengthy (several days), an industrial application of the twin-roll steel casting process would require there to be a large number of sleeves ready to use, in order to ensure regular operation of the casting machine. Since the sleeve is a very expensive component, because of the materials used and the difficulty of machining it, this would lead to a high cost in the use of the plant.

SUMMARY OF THE INVENTION

The object of the invention is to improve the behavior of the metal coating of the sleeve with respect to its resistance to thermomechanical stresses, by slowing down as much as possible, or even preventing, the appearance of cracks in the edge regions so as to extend the average use time of the sleeve between two restorations of its coating.

The subject of the invention is a process for electrolytically coating the casting surface of a roll, for the twin-roll or single-roll continuous casting of thin metal strip, with a metal layer, in which process said casting surface is at least partially immersed in an electrolyte solution, containing a salt of the metal to be deposited, so as to face at least one anode, said surface is placed as the cathode and a relative movement is created between said casting surface and said electrolyte solution, wherein insulating masks are interposed between said anode or anodes and the arrises of said casting surface, said insulating masks preventing a concentration of the lines of current on said arrises and in their vicinity.

The subject of the invention is also a plant for electrolytically coating the casting surface of a roll, for the twin-roll or single-roll continuous casting of thin metal strip, with a metal layer, of the type comprising a tank which contains an electrolyte containing a salt of the metal to be deposited, means for immersing said casting surface at least partially in said tank and for creating a relative movement between said casting surface and said electrolyte, at least one anode arranged in the tank so as to face said casting surface, and means for raising said casting surface to a cathode potential, which plant includes masks, made of an insulating material, which are interposed between the arrises of said casting surface and said anode or anodes, said masks preventing a concentration of the lines of current on said arrises.

Preferably, said masks have a general shape in the form of a circular arc, the center of curvature of which is the same as that of the arris of the casting surface which they face, and have two parallel sides each placed in the extension of said arris at the same distance "d" from the latter and connected by a corner-shaped cut-out, the sides of which are perpendicular to each other.

As will be understood, the invention consists in carrying out the electrodeposition of the metal coating by arranging insulating masks near the edges of the sleeves. These masks, a preferred example of which is described, are designed to obtain a uniform distribution of the lines of current in the edge regions of the sleeve. This gives the coating a uniform thickness in these regions, in conformity with the desired nominal thickness.

The inventors have found that there was a correlation between the rapidity with which cracks appear in the nickel coating in the edge regions of the sleeve and the thickness uniformity of this coating in these same regions, in particular in line with the arrises. In the absence of any special device designed to prevent this phenomenon, excess thicknesses of the nickel coating are found in the immediate vicinity of the arrises of the sleeve and in line with these arrises themselves. For example, if the nominal thickness of the coating is 2 mm over the major part of the surface of the sleeve, this thickness is sometimes found to be greater than 7 mm in line with the arrises. These excess thicknesses are due to concentrations of the lines of current in the immediate vicinity of the arrises. Even if these concentrations only exist over a very limited portion of the sleeve, they seem to be sufficient to cause the rapid appearance of the cracks mentioned above. This is because it turns out that they make it possible for hydrogen to form, which may create gas inclusions in the deposition being formed. Moreover, these concentrations make the crystalline structure of the nickel coating, and therefore its hardness and its texture, non-uniform between the arris and the rest of the sleeve.

One means of reducing this excess thickness of the coating consists in giving the arris a radius of curvature of a few mm, instead of making it a sharp edge. However, in practice, this radius cannot exceed 1 to 2 mm, otherwise the risk of liquid metal infiltrating between the ends of the rolls and the refractory side plates is excessively increased.

Another known means consists in deflecting the lines of current by means of devices called "current robbers". These are metal conductors, arranged so as to be parallel to the arrises and in their vicinity, through which a current passes. They deflect towards them some of the lines of current which, in their absence, would concentrate on the arris of the sleeve and in its vicinity. However, this solution used alone is not satisfactory either. Moreover, the positions and operating parameters for these current robbers must be carefully determined, since otherwise, in addition to the excess thickness which may remain in line with the edge, it may sometimes be found that, on the contrary, the nickel layer has in places a thickness less than the normal thickness, a sign that the lines of current were excessively deflected from the corresponding regions. Moreover, as the electroplating progresses, nickel is deposited on the current robbers in non-negligible quantities. It is therefore necessary to recover this nickel, and the current which has been consumed in order to deposit it represents a pure loss. But above all, this nickel deposition makes the dimensions of the current robbers vary, and which moreover does so in a very irregular manner. The action of the current robbers therefore varies very greatly as the operations progress, making it very difficult to manage them. In practice, for a desired coating thickness of 2 mm, a coating having a thickness of 2.5 mm on the arrises is observed at best, this being still too high to solve satisfactorily the problem posed. The current robbers are therefore unable reliably to achieve satisfactory uniformity of the nickel deposition for this application, peculiar to the coating of continuous casting rolls.

The inventors have found that the most reliable way of obtaining very uniform nickel deposition on the arrises of the sleeve and in their immediate vicinity was to place insulating masks, preferably in a defined configuration, a short distance from the arrises, and that, under these conditions, the premature appearance of cracks in the coating in the edge regions of the sleeves could be eliminated.

BRIEF DESCRIPTION OF THE DRAWINGS

The invention will be more clearly understood on reading the following description, which refers to the following figures.

DESCRIPTION OF THE PREFERRED EMBODIMENTS

Figure 1:
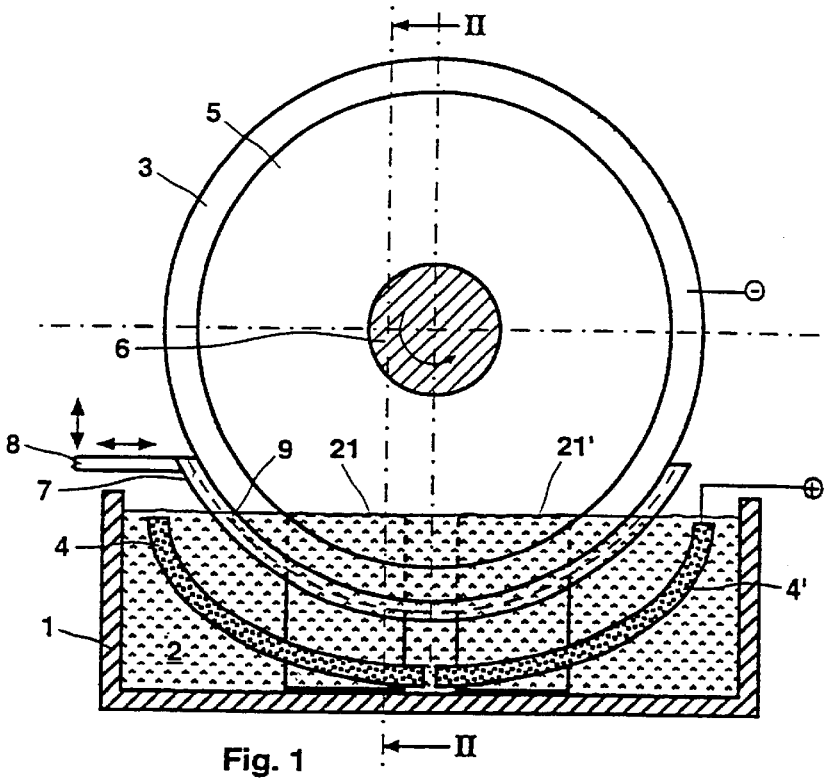
FIG. 1, which shows diagrammatically, seen end on and in cross section on I—I, a plant for coating a twin-roll casting roll sleeve, designed for implementation of the process according to the invention.

FIG. 1 shows, in cross section, a plant according to the invention, the plane of section lying within the tank 1 containing the electrolyte solution 2, the main component of which is a nickel salt, but in front of the copper sleeve 3 placed as the cathode and of the two anodes 4, 4' arranged in the bottom of the tank 1. The sleeve 3, which has a cylindrical external shape and an external diameter of 1500 mm, is mounted on an arbor 5 whose shaft 6, during the electroplating operation, is rotated by means which are not shown. At least the lower part of the sleeve 3 is immersed in the electrolyte solution. In the example shown, the anodes 4, 4' are soluble anodes consisting of curved titanium anode baskets filled with nickel granules. However, this is merely an example of one embodiment, and a different number of anodes and another configuration could be provided (for example, an insoluble anode). The anodes 4, 4' extend behind the plane of section over a width greater than that of the sleeve 3. Arranged so as to face the edges of the sleeve 3 are masks 7, 7' (only 7 being visible in FIG. 1) made of an insulating material, such as a polymer, the function of which is to prevent the lines of current coming from the anodes 4, 4' from reaching the edge regions and the arrises of the sleeve 3 directly, so as to avoid excess thicknesses of the nickel coating thereon. The positions of these masks 7, 7' with respect to the sleeve 3 may be adjusted by positioning means shown symbolically by movable rods 8.

Figure 2:
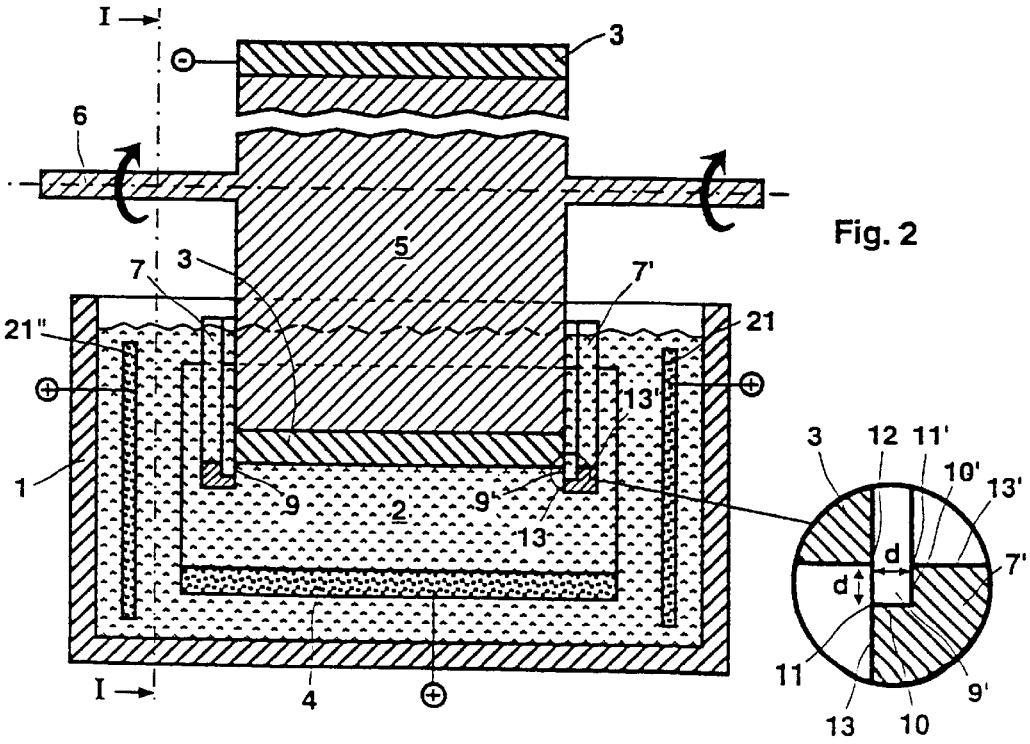
FIG. 2, which shows a sectional view on II—II of this same plant, explaining the preferred configuration of the masks according to the invention.

The precise configuration of these masks 7, 7' is shown in FIG. 2. In the example shown, they are in the form of elongate bodies of approximately square or rectangular cross section and have the general shape of a circular arc, the center of curvature of which is the same as that of the arris of the sleeve 3 which they face. Their upper edge closest to the sleeve edge where their action is exerted has a corner-shaped cut-out 9, 9', the two sides 10, 10' of which are perpendicular and of approximately equal length, about 5 mm for example. The masks 7, 7' are arranged by means of the rods 8 in such a way that the external edges 11, 11' of the cut-outs 9, 9' are each placed approximately at the same distance "d" from the arris 12 of the sleeve 3 facing which they are arranged. This distance "d" is initially about 5 mm when it is desired to deposit nickel to a thickness of 2 to 3 mm. On the other hand, the sides 13, 13' of each mask 7, 7', which are perpendicular to the sleeve 3, must, in this example of an embodiment of the invention, have a minimum length of 50 mm. It is under these conditions that the masks 7, 7' can deflect the lines of current sufficiently to optimize the uniformity of their distribution in the edge regions of the sleeve 3.

Optionally, it is possible to arrange for the masks 7, 7' to move progressively away from the sleeve 3 as the thickness of the nickel coating increases. This movement may be performed in successive steps or continuously. It is thus possible to ensure that enough space always remains between the mask and the coating in order to allow growth of the nickel coating.

Depending on the precise configuration of the anodes 4, 4' and of the masks 7, 7', the coating of the ends of the sleeve 3 will be carried out uniformly over a greater or lesser portion of their surface. In order to increase this portion, vertical anodes 21, 21', 21", such as anode baskets filled with nickel granules, similar to the anode baskets 4, 4' and facing the ends of the sleeve 3, may, as in the prior art to which mention has been made, be placed in the tank 1.

It is clear that the masks may differ in their construction from those which have just been given as an example, provided that they enable the desired uniformity in the thickness of the coating to be obtained. In particular, instead of consisting of elongate bodies of square, rectangular or other cross section, they may consist of a plate or an assembly of plates, that surface of which plate or assembly of plates which is turned towards the sleeve preferably having the same configuration as that of the elongate bodies in the example. In other words, this surface must preferably include two parallel edges each placed in the extension of the arris of the sleeve at the same distance "d" from the latter and connected by a corner-shaped cut-out, the sides of which are perpendicular to each other.

The invention does not exclude the possibility, in order to supplement and further refine the action of the masks, of also making permanent or intermittent use of current robbers, these being incorporated in the masks or independent of the latter.

Of course, the invention can be applied to depositing metals other than nickel on the sleeve. Likewise, the roll thus coated can be used not only on a machine for the twin-roll continuous casting of thin metal strip (made of steel or of another material), but also on a machine for the continuous casting of thin strip in which a single rotating roll licks the surface of a metal bath (single-roll casting). Moreover, it can also be applied to the case of the coating of the casting surface of a solid roll in which the sleeve and the core would constitute merely one and the same piece. It is also easy to transpose it to a case in which the sleeve or the solid roll could be completely immersed in the electrolyte bath. Finally, as mentioned, the relative movement between the sleeve and the electrolyte may be created by keeping the sleeve stationary and by moving the electrolyte around it. This may be achieved, in particular, if the sleeve is totally immersed in the electrolyte and if the movements of the electrolyte are created by suitably oriented jets in order to circulate the electrolyte around the sleeve between the anode or anodes.

What is claimed is:

1. A process for electrolytically coating the casting surface of a roll for the twin-roll or single-roll continuous casting of thin metal strip with a metal layer, comprising the steps of at least partially immersing said casting surface in an electrolyte solution containing a salt of the metal to be deposited, said surface being placed at a cathode so as to face at least one anode, providing an electrical current between said cathode and anode, and providing a relative movement between said casting surface and said electrolyte solution, wherein insulating masks are interposed between said anode or anodes and arrises of said casting surface to prevent a concentration of lines of current on said arrises and in their vicinity, said masks being interposed such that no substantial overlap occurs between a surface of said masks and a surface of said roll.

2. The process as claimed in claim 1, further comprising the step of progressively moving said masks away from said arrises as a thickness of the metal layer increases.

3. A plant for electrolytically coating the casting surface of a roll for the twin-roll or single-roll continuous casting of thin metal strip with a metal layer, comprising a tank which contains an electrolyte including a salt of the metal to be deposited, means for immersing said casting surface at least partially in said tank and for creating a relative movement between said casting surface and said electrolyte, at least one anode arranged in the tank so as to face said casting surface, means for raising said casting surface to a cathode potential, and masks, made of an insulating material, which are interposed between arrises of said casting surface and said anode or anodes, said masks preventing a concentration of the lines of current on said arrises, and being interposed such that no substantial overlap occurs between a surface of said masks and a surface of said roll.

4. The plant as claimed in claim 3, wherein said masks have a general shape in the form of a circular arc, the center of curvature of which is the same as that of the arris of the casting surface which they face, and have two parallel sides each placed in the extension of said arris at the same distance "d" from the latter and connected by a corner-shaped cut-out, the sides of which are perpendicular to each other.

5. The plant as claimed in claim 4, wherein said masks consist of elongate bodies.

6. The plant as claimed in claim 4, wherein said masks consist of plates or assemblies of plates.

7. The plant as claimed in claim 3, which comprises means for progressively moving said masks away from said arrises as said metal layer increases.

8. The plant as claimed in claim 3, which also includes anodes which are each arranged so as to face an end of said casting surface.

9. The plant as claimed in claim 3, which also includes current robbers.

10. The plant as claimed in claim 9, wherein said current robbers are incorporated into said masks.

11. The plant as claimed in claim 3, wherein said means for creating a relative movement between said casting surface and said electrolyte are means for rotating said casting surface.

12. The plant as claimed in claim 3, wherein said means for creating a relative movement between said casting surface and said electrolyte are means for circulating said electrolyte around said casting surface.

* * * * *

UNITED STATES PATENT AND TRADEMARK OFFICE

CERTIFICATE OF CORRECTION

PATENT NO. : 6,228,242 B1
DATED : May 8, 2001
INVENTOR(S) : Herve Lavelaine,Eric Jolivet ;Yann Breviere; Christian Allely; Jean - Claude Catonne It is certified that error appears in the above-identified patent and that said Letters Patent is hereby corrected as shown below:

Title page,
Item (73) Assignee: USINOR, Puteaux, FRANCE and Thyssen Stahl, Aktiengesellschaft, Duisburg, GERMANY Signed and Sealed this Fourth Day of September, 2001

*Attest:*

Nicholas P. Godici

*Attesting Officer*

NICHOLAS P. GODICI
*Acting Director of the United States Patent and Trademark Office*